US005261972A

United States Patent [19]

Kuroki et al.

[11] Patent Number: 5,261,972

[45] Date of Patent: Nov. 16, 1993

[54] PROCESS FOR PRODUCING GRAIN-ORIENTED ELECTRICAL STEEL STRIP HAVING HIGH MAGNETIC FLUX DENSITY

[75] Inventors: Katsuro Kuroki; Yasunari Yoshitomi; Hiroaki Masui; Tsutomu Haratani, all of Kitakyushu, Japan

[73] Assignee: Nippon Steel Corporation, Tokyo, Japan

[21] Appl. No.: 965,650

[22] Filed: Oct. 22, 1992

[30] Foreign Application Priority Data

Oct. 28, 1991 [JP] Japan ..... 3-281072

[51] Int. Cl.[5] ..... H01F 1/04

[52] U.S. Cl. ..... 148/111; 148/113

[58] Field of Search ..... 148/111, 112, 113

[56] References Cited

U.S. PATENT DOCUMENTS

| | | | |
|---|---|---|---|
| 5,082,509 | 1/1992 | Ushigami et al. | 148/111 |
| 5,145,533 | 9/1992 | Yoshitomi et al. | 148/111 |

FOREIGN PATENT DOCUMENTS

| | | | |
|---|---|---|---|
| 0232537 | 8/1987 | European Pat. Off. . | |
| 0321695 | 6/1989 | European Pat. Off. . | |
| 0378131 | 7/1990 | European Pat. Off. . | |
| 0390142 | 10/1990 | European Pat. Off. | 148/111 |
| 40-15644 | 7/1965 | Japan . | |
| 46-23820 | 7/1971 | Japan . | |
| 47-25250 | 7/1972 | Japan . | |
| 50-15727 | 2/1975 | Japan . | |
| 61-60896 | 12/1986 | Japan . | |
| 1-230721 | 9/1989 | Japan . | |
| 2-13009 | 4/1990 | Japan . | |
| 2-182866 | 7/1990 | Japan . | |
| 2-259019 | 10/1990 | Japan . | |
| 2130241 | 5/1984 | United Kingdom . | |

OTHER PUBLICATIONS

Patent Abstracts of Japan vol. 9, No. 228(C-303)(1951), Sep. 13, 1985.

*Primary Examiner*—John P. Sheehan

*Attorney, Agent, or Firm*—Kenyon & Kenyon

[57] ABSTRACT

The present invention discloses a process for producing a grain-oriented electrical steel strip having a high magnetic flux density. The process comprises hot-rolling a steel ingot comprising basic ingredients and, added thereto, 0.02 to 0.15% of Sn at a temperature of 1200° C. or below, annealing the hot-rolled strip, cold-rolling the annealed strip with a final rolling reduction of 80% or more and subjecting the cold-rolled strip to decarburization annealing, a nitriding treatment and finish annealing, wherein the temperature, T°C., of annealing of the hot-rolled strip is set so as to fall within the range $1240-2.1\times Al_R<T<1310-1.8\times Al_R$ (wherein $Al_R$ = acid soluble [Al] − 27/14 × [N]) and the strip is soaked for 180 sec or less, maintained at a temperature in the range of from 800° to 950° C. for 30 to 300 sec and then quenched.

The grain-oriented electrical steel strip thus produced is not influenced by the variation in the [Al] and [N].

According to the present invention, a grain-oriented electrical steel strip having a very high magnetic density can be stably prepared through the establishment of a proper relationship between the Al and N ingredients and conditions for annealing of a steel strip before final cold rolling and the growth of a primary recrystallized grain to optimize the annealing conditions and the practice of a nitriding treatment after decarburization annealing.

2 Claims, 2 Drawing Sheets

PROCESS FOR PRODUCING GRAIN-ORIENTED ELECTRICAL STEEL STRIP HAVING HIGH MAGNETIC FLUX DENSITY

BACKGROUND OF THE INVENTION

1. Field of the Invention

The present invention relates to a process for producing a grain-oriented electrical steel strip for use as an iron core of electrical equipment. In particular, the present invention is concerned with a process for producing a grain-oriented electrical steel strip having a very high magnetic flux density through studies and optimization of conditions for annealing of a hot-rolled strip after hot rolling in a production process wherein a steel slab is heated at 1200° C. or below, that is, a production process wherein an inhibitor is formed in situ after the completion of cold rolling in a one-stage cold-rolling process or two-stage cold rolling process.

2. Description of the Prior Art

A grain-oriented electrical steel strip is produced so as to exhibit an excellent magnetic property only in the direction of rolling, and can be used to produce a transformer having excellent performance. The grain-oriented electrical steel strip is characterized by a secondary recrystallized grain from the viewpoint of the growth of a crystal. In order to accelerate the growth of the secondary recrystallized grain, it is necessary to regulate the growth of a primary recrystallized grain through the addition of a very small amount of an inhibitor element. For example, in a two-stage cold rolling process, in many cases, MnS is used as the inhibitor. In general, this process comprises adding Mn or S in the step of producing a steel, hot-rolling the steel, cold-rolling the hot-rolled steel twice with intermediate annealing being conducted between the cold-rollings into a strip having a final thickness and subjecting the strip to decarburization annealing and final annealing to grow a crystal grain.

In one-stage the cold rolling process, in many cases, AlN is used as the inhibitor. In this process, conditions for the inhibitor are important, and regulation is conducted so that the growth of the primary recrystallized grain is prevented while the secondary recrystallization is accelerated. Specifically, in the one-stage cold rolling process, it is known that in order to obtain a secondary recrystallized grain having a higher degree of pole concentration, the inhibitor should exhibit a stronger restraint than that in the case of the two-stage cold rolling process for the purpose of suppressing the growth of a primary recrystallized grain having a smaller size derived from a high rolling reduction and, at the same time, conducting the formation and growth of a secondary recrystallization nucleus.

A grain-oriented electrical steel strip is used mainly as an iron core material for a transformer, a generator and other electrical equipment. A high magnetic flux density, a watt loss and a magnetostriction at an ordinary frequency are important properties required of the grain-oriented electrical steel strip. The magnetic flux density is determined by the degree of pole concentration of {110}<001> orientation. Further, the grain-oriented electrical steel strip should have excellent magnetic properties, that is, a magnetization property and a watt loss property, and further should have a good coating.

The grain-oriented electrical steel strip can be prepared by selectively evolving a crystal grain having the so-called "Goss texture", that is, having a {110} plane on the rolled plane and a <001> axis in the direction of rolling through the utilization of a secondary recrystallization phenomenon.

As is well known in the art, the secondary recrystallization occurs in finish annealing after decarburization annealing subsequent to cold rolling. In order to satisfactorily form the secondary recrystallization, the growth of the primary recrystallized grain should be inhibited as much as possible until the temperature reaches a secondary recrystallization region. For this reason, fine precipitates such as AlN, MnS and MnSe, that is, inhibitors should be present in the steel.

Therefore, in the process for producing an electrical steel, an electrical steel slab is heated at a high temperature of 1350° to 1400° C. for completely dissolving an inhibitor forming element added in the stage of making a steel, for example, Al, Mn, S, Se or N. Thus, the inhibitor forming element completely dissolved in a solid solution form in the electrical steel slab finely precipitates as AlN, MnS and MnSe through intermediate annealing at the stage of a hot-rolled strip after hot rolling or an intermediate gauge before the final cold rolling.

With respect to prior art relevant to the above-described process, Japanese Examined Patent Publication (Kokoku) No. 46-23820 discloses a method for precipitating AlN having a preferred size in the steel strip which comprises incorporating C and Al in a common steel or a silicon steel to form a secondary recrystallized grain having a {110}<001> orientation, wherein annealing immediately before the final cold rolling is conducted at a temperature of 750° to 1200° C. and quenching is conducted at a temperature of 750° to 950° C. depending upon the amount of Si. Japanese Unexamined Patent Publication (Kokai) No. 50-15727 discloses a process for producing a grain-oriented electrical steel strip which comprises hot-rolling a steel containing C, Al, Mn, N, Cu or the like and cold-rolling the steel at least once, wherein, before the final cold rolling, the steel strip is annealed at a temperature of 760° to 1177° C. for 15 sec to 2 hr and cooled from a temperature of 927° C. or less and 400° C. or above to a temperature of about 260° C. or below at a rate higher than a natural cooling rate.

These method can be applied only to the material which is hot-rolled after completely dissolved a fine precipitation by raising a heating temperature of a steel slab.

In such a process, as described above, since the electrical steel slab is heated at a high temperature, the amount of occurrence of a molten scale (slag) during the heating is so large that the frequency of repair of the heating furnace becomes high. This gives rise to problems such as an increase in the maintenance cost, a lowering in the operation rate of facilities and an increase of fuel consumption in unit of steel. Studies have been made on a process for producing a grain-oriented electrical steel strip having excellent properties wherein an electrical steel slab is heated at a lowered temperature. For example, Japanese Examined Patent Publication (Kokoku) No 61-60896 discloses a process which comprises heating a material comprised of an electrical steel slab having a Mn content of 0.08 to 0.45%, a S content of 0.007% or less, a lowered value of the product [Mn][S] and, incorporated therein, Al, P and N at a temperature of 1200° C. or below. And Japanese Unexamined Patent Publication (Kokai) No. 1-230721 discloses the same process which comprises heating an electrical steel slab containing Al, N, B, Ti or the like at a temperature of 1200° C. or below. In recent years, as opposed to the above-described process wherein an inhibitor is formed in situ through a solution heat treatment at a high temperature before the step of cold rolling, a process wherein the inhibitor is formed in situ in a step after the cold rolling has been developed. This has enabled a grain-oriented electrical steel strip having excellent properties to be produced through the regulation of the texture (recrystallization ratio, transformation phase, etc.) alone in the steps of hot rolling and annealing of hot-rolled strip.

As well known in the art, the secondary recrystallization phenomenon occurs during finish annealing after decarburization annealing subsequent to cold rolling. In order to satisfactorily form the secondary recrystallization, the growth of the primary recrystallized grain should be inhibited as much as possible until the temperature reaches a secondary recrystallization region. For this reason, fine precipitates such as AlN, MnS and MnSe, that is, inhibitors, should be present in the steel.

The present invention provides a process for producing a grain-oriented electrical steel strip having a very high magnetic flux density through studies and optimization of conditions for annealing of a hot-rolled strip after hot rolling in a production process wherein a steel slab is heated at 1200° C. or below, that is, a production process wherein an inhibitor is formed in situ after the completion of cold rolling in one-stage cold-rolling process or two-stage cold rolling process.

SUMMARY OF THE INVENTION

The mean grain diameter and the grain diameter distribution which regulate the structure of a strip subjected to decarburization annealing are important to a process for producing a grain-oriented electrical steel strip wherein an electrical steel slab is heated at a low temperature of 1200° C. or below. Further, the regulation of the texture and the formation of an inhibitor in situ, for example, nitriding, as well are important. In particular, the structure and texture of a strip subjected to decarburization annealing are important to magnetic properties of the product such as a high magnetic flux density, a watt loss and a magnetostriction in an ordinary frequency. The magnetic flux density is determined by the degree of pole concentration of $\{110\}<001>$ orientation. Further, the grain-oriented electrical steel strip should have excellent magnetic properties, that is, excellent magnetization property and watt loss property, and further should have a good coating.

With respect to the influence of the microstructure, Japanese Unexamined Patent Publication (Kokai) No. 2-182866 proposes that the mean diameter of the primary recrystallized grain and the coefficient of variation of the diameter are limited to 15 μm and 0.6 or less, respectively. The present inventors have made further studies of this proposal. As a result, they have found that the structure before cold rolling, the size and the state of distribution of the precipitate, the temperature of annealing after cold rolling, etc., are factors having an effect on the microstructure. The annealing of the hot-rolled strip (including annealing before final cold rolling) and decarburization annealing have an effect on these factors.

The present inventors have made further detailed studies, and clarified the influence of the relationship between ingredients (Al, N) of the steel and conditions for annealing of the steel strip and the growth of the primary recrystallized grain at the time of decarburization annealing on the magnetic flux density of the grain-oriented electrical steel strip. This has led to the development of a grain-oriented electrical steel strip having a very high magnetic flux density unattainable in the prior art through the optimization of conditions for annealing of a hot-rolled strip and the practice of a nitriding treatment in the step after decarburization annealing.

The subject matter of the present invention is as follows.

(1) A process for producing a grain-oriented electrical steel strip having a high magnetic flux density, comprising the steps of:

heating an electrical steel slab comprising, by weight, 0.025 to 0.075% of C, 2.5 to 4.5% of Si, 0.015% or less of S, 0.015 to 0.04% of acid-soluble Al, less than 0.010% of N and 0.050 to 0.45% of Mn with the balance consisting of Fe and unavoidable impurities at a temperature 1200° C. or below;

hot-rolling the heated slab into a hot-rolled strip having a predetermined thickness;

cold-rolling the hot-rolled steel strip once or two times or more with intermediate annealing being conducted between the cold rollings into a cold-rolled steel strip with a final rolling reduction of 80% or more; and subjecting the cold-rolled steel strip to decarburization annealing and finish annealing, wherein the strip before final cold-rolling is annealed through a two-stage soaking process which comprises establishing the relationship between a higher soaking temperature, T°C., and $Al_R$ (acid-soluble $[Al]-27/14\times[N]$) (ppm) determined from the compositions of the hot-rolled strip so as to fall within $1240-2.1\times TAl_R<T<1310-1.8\times TAl_R$ (the maximum temperature: 1150° C., the minimum temperature: 950° C.), soaking the strip at the determined temperature, T°C., for 180 sec or less, holding the strip at a lower soaking temperature of 800° to 950° C. for 30 sec to 300 sec and cooling the strip to room temperature at a rate of 10° C./sec or more, and the steel strip is nitrided between when the decarburization annealing is completed and when the temperature reaches a secondary recrystallization initiation temperature of the steel strip in the finish annealing.

(2) A process for producing a grain-oriented electrical steel strip having a high magnetic flux density according to the above item (1), wherein the electrical steel slab as the starting material comprises, by weight, 0.025 to 0.075% of C, 2.5 to 4.5% of Si, 0.015% or less of S, 0.015 to 0.040% of acid-soluble Al, less than 0.010% of N, 0.050 to 0.45% of Mn, 0.02 to 0.15% of Sn and 0.05 to 0.15% of Cr with the balance consisting of Fe and unavoidable impurities.

The present invention having the above-described constitution provides a process for producing a grain-oriented electrical steel strip through the establishment of a proper relationship between the Al and N compositions and conditions for annealing of a steel strip before final cold rolling and the growth of a primary recrystallized grain to optimize the annealing conditions and the practice of a nitriding treatment after decarburization annealing.

DESCRIPTION OF PREFERRED EMBODIMENTS

Figure 1:
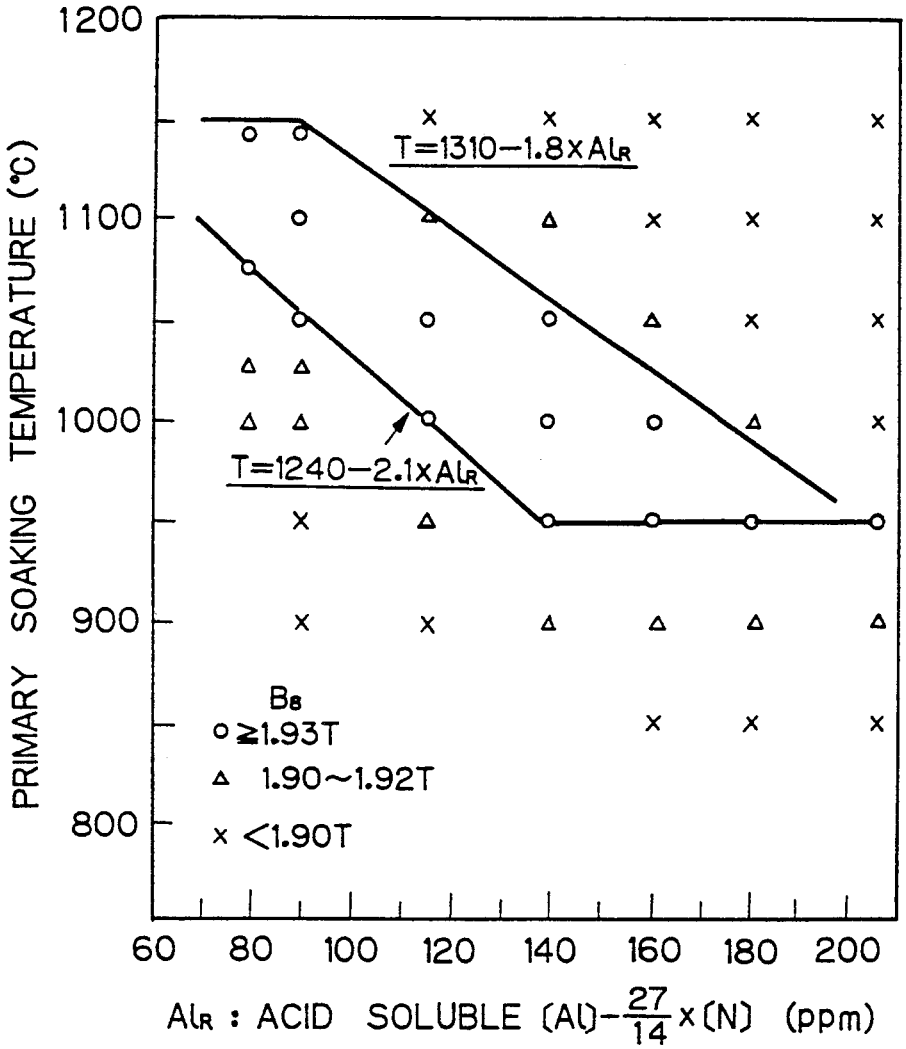
FIG. 1 is a diagram showing the relationship between $Al_R$ and the primary soaking temperature in the present invention.

The present invention which has been made with a view to solving the problems of the prior art will now be described in more detail.

Chemical ingredients which are the first requirement of the present invention will now be described. In the present invention, the reason for the limitation of the ingredient composition of the electrical steel slab to (1) one comprising, by weight, 0.025 to 0.075% of C, 2.5 to 4.5% of Si, 0.015% or less of S, 0.015 to 0.040% of acid-soluble Al, less than 0.0I % of N and 0.050 to 0.45% of Mn and the reason for the limitation of the chemical composition of the electrical steel slab to (2) one comprising, by weight, 0.025 to 0.075% of C, 2.5 to 4.5% of Si, 0.015% or less of S, 0.015 to 0.040% of acid-soluble Al, less than 0.010% of N and 0.050 to 0.45% of Mn, 0.02 to 0.15% of Sn and 0.05 to 0.15% of Cr will now be described.

C (carbon): When the C content is less than 0.025%, the secondary recrystallization in the step of annealing becomes so unstable that the magnetic flux density ($B_8$) of the product becomes less than 1.80 Tesla even though the secondary recrystallization is conducted. On the other hand, when the C content exceeds 0.75%, the time necessary for decarburization annealing becomes so long that the productivity is decreased.

Si (silicon): When the Si content is less than 2.5%, it is difficult to prepare a product having a low watt loss. On the other hand, when the Si content exceeds 4.5%, cracking and breaking frequently occur, which makes it impossible to stably conduct a cold rolling operation.

One of the features of the ingredients of the electrical steel slab according to the present invention resides in that the S (sulfur) content is 0.015% or less, preferably 0.007% or less. In a known technique, for example, a technique disclosed in, for example, Japanese Examined Patent Publication (Kokoku) No. 40-15644 or Japanese Examined Patent Publication (Kokoku) No. 47-25250, S has been indispensable as an element for forming MnS which is one of the precipitates necessary for inducing a secondary recrystallization.

In the above-described known technique, there is a S content range in which S exhibits the best effect, and such a content range has been specified as an amount capable of dissolving MnS at the stage of heating of the slab prior to the hot rolling.

In the present invention wherein use is made of (Al, Si)N as an inhibitor, MnS is not particularly necessary and an increase in MnS is unfavorable from the viewpoint of magnetic properties. Therefore, in the present invention, the S content is 0.015% or less, preferably 0.007% or less.

Al (aluminum): Al combines with N to form AlN. The formation of (Al, Si)N through nitriding of the steel after the completion of the primary recrystallization is indispensable to the present invention. For this reason, a given amount or more of free Al becomes necessary. Therefore, the addition of Al in an amount of 0.015 to 0.040% in terms of acid soluble Al becomes necessary.

N (nitrogen): The N content should be 0.010% or less. When it exceeds 0.010%, blistering occurs on the surface of the steel strip. Further, it becomes difficult to regulate the primary recrystallized grain. The lower limit may be 0.0020%. This is because it becomes difficult to evolve a secondary recrystallized grain.

Mn (manganese): When the Mn content becomes excessively low, the secondary recrystallization becomes unstable. On the other hand, when the Mn content is excessively high, it becomes difficult to prepare an electrical steel product having a high magnetic flux density. For this reason, the content is preferably in the range of from 0.050 to 0.45%.

Sn (tin) and Cr (chromium): The addition of Sn in combination with Cr can stabilize the formation of the glass film after finish annealing. In particular, Sn can improve the texture of primary recrystallized grain after decarburization annealing and in its turn can refine the secondary recrystallized grain to stabilize the glass film in concert with improving the watt loss. However, when the Sn content is excessively high, it becomes difficult to conduct nitriding, so that the secondary recrystallized grain can not grow. On the other hand, the optimal content of Cr is in the range of from 0.050 to 0.15%.

The incorporation of a very small amount of Cu, P and Ti in the steel does not detract from the object of the present invention.

The step of rolling and the step of heat treatment in the process of the present invention will now be described.

The electrical steel slab is prepared by melting an electrical steel in a LD converter or an electric furnace, optionally subjecting the melt to a vacuum degassing treatment and subjecting the slab to continuous casting or blooming after ingot making. Thereafter, the slab is heated prior to hot rolling. In the process of the present invention, the slab is heated at a low temperature of 1200° C. or below, and the amount of consumption of heating energy is reduced. At the same time, AlN in the steel is not completely dissolved in a solid solution form and is brought to an incomplete solid solution form. Further, it is needless to say that MnS having a high solid solution temperature becomes an incomplete solid solution form. The steel slab is hot-rolled into a hot-rolled strip having a predetermined thickness.

The annealing of hot-rolled strip characteristic of the present invention will now be described based on experimental results.

An ingot comprising 0.054% of C, 3.25% of Si, 0.14% of Mn, 0.007% of S, 0.05% of Sn and 0.10% of Cr as base components and, added thereto, acid-soluble [Al] and [N] in amounts varied as given in Table 1 was heated to 1150° C. and hot-rolled into a hot-rolled strip having a thickness of 2.0 mm. The hot-rolled strip was annealed under conditions given in Table 2.

TABLE 1

| Ingot No. | Acid soluble [Al] (%) | [N] (%) | $Al_R$ (ppm) (acid-soluble [Al] - 27/14x [N]) |
|---|---|---|---|
| 1 | 0.022 | 0.0072 | 80 |
| 2 | 0.023 | 0.0075 | 90 |
| 3 | 0.026 | 0.0075 | 115 |
| 4 | 0.028 | 0.0072 | 140 |
| 5 | 0.030 | 0.074 | 160 |

TABLE 1-continued

| Ingot No. | Acid soluble [Al] (%) | [N] (%) | $Al_R$ (ppm) (acid-soluble [Al] - 27/14x [N]) |
|---|---|---|---|
| 6 | 0.033 | 0.0077 | 185 |
| 7 | 0.035 | 0.0075 | 205 |

TABLE 2

| Condition | Primary soaking temp. (°C.) | Secondary soaking temp. (°C.) | Quenching rate |
|---|---|---|---|
| 1 | 1150° C. × 30 sec (soaking time) | 900° C. × 120 sec (time in furnace) | 40° C./sec → room temp. |
| 2 | 1100° C. × 30 sec | 900° C. × 120 sec | 40° C./sec → room temp. |
| 3 | 1050° C. × 30 sec | 900° C. × 120 sec | 40° C./sec → room temp. |
| 4 | 1000° C. × 30 sec | 900° C. × 120 sec | 40° C./sec → room temp. |
| 5 | 950° C. × 30 sec | 900° C. × 120 sec | 40° C./sec → room temp. |
| 6 | 900° C. × 150 sec | — | 40° C./sec → room temp. |
| 7 | 850° C. × 150 sec | — | 40° C./sec → room temp. |

Thereafter, the material was pickled, cold-rolled into a thickness of 0.23 mm and then subjected to decarburization annealing at a temperature of 835° C. in an atmosphere comprising 25% of $N_2$ and 75% of $H_2$ and having a dew point of 60° C. Further, the nitriding treatment was conducted at 750° C. for 30 sec in a mixed gas comprising $N_2$, $H_2$ and $NH_3$ to adjust the $N_2$ content of the steel strip after nitriding to about 200 ppm. Thereafter, the material was coated with an annealing release agent composed mainly of MgO and TiO and subjected to finish annealing at 1200° C. for 20 hr. The relationship between $Al_R$ of ingot, primary soaking temperature (T°C.) in annealing of hot-rolled strip and magnetic flux density is shown in FIG. 1. From FIG. 1, it is apparent that a high magnetic flux density can be obtained within $1240-2.1\times Al_R<T<1310-1.8\times Al_R$.

Then, the influence of the secondary soaking temperature was studied through the use of a hot-rolled strip of ingot No. 4 specified in Table 1, and the results of the optimization of the conditions will now be described. The annealing of the hot-rolled strip was conducted under the following conditions.

Figure 2:
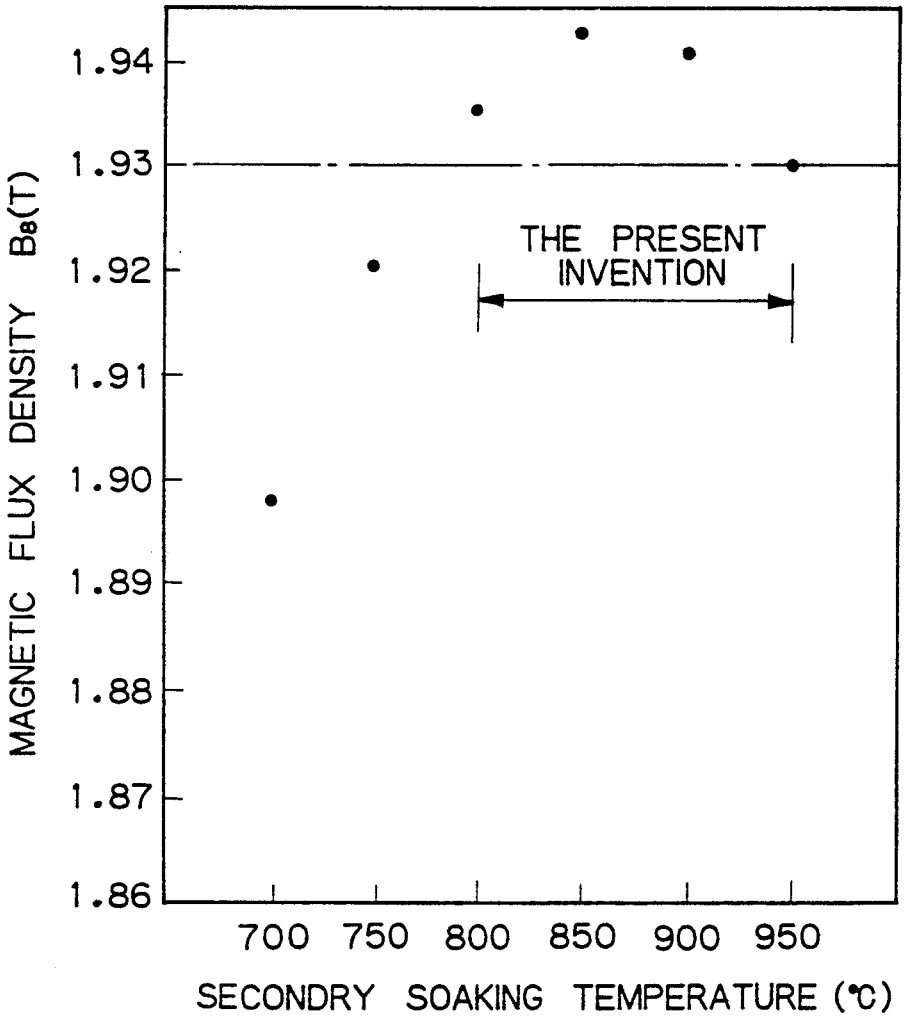
FIG. 2 is a diagram showing the relationship between the secondary soaking temperature and the magnetic flux density ($B_8$).

Primary soaking temperature: 1000° C.
Soaking time: 30 sec
Secondary soaking temperature: 700° to 950° C.
Time in furnace: 120 sec Thereafter, treatments subsequent to the annealing were conducted under the same condition as that described above. The results are given in FIG. 2. From FIG. 2, it is apparent that the secondary soaking temperature capable of providing a magnetic flux density ($B_8$) of 1.93 Tesla or more is in the range of from 800° to 950° C.

Further, various studies were conducted on the primary and secondary soaking times. As a result, it was found that the optimal soaking time of the primary soaking temperature and residence time of the secondary soaking temperature were 180 sec or less and 30 sec to 300 sec, respectively. A high magnetic flux density can be stably obtained when the rate of cooling from the secondary soaking temperature region is 10° C./sec or above. These soaking conditions can be applied to annealing conducted after the hot-rolled strip is pickled and cold-rolled.

Although the reason why a high magnetic flux density ($B_8$) can be obtained by the annealing has not been elucidated yet, it is believed to be as follows.

Examples of the factor having an effect on the secondary recrystallization phenomenon including the orientation of the secondary recrystallization include a primary recrystallized structure (mean grain diameter and grain diameter distribution), texture, strength of inhibitor, etc. The texture and grain diameter distribution change accompanying the growth of grain after the completion of the primary recrystallization. In order to facilitate the nucleation and the grain growth of the secondary recrystallization, it is desired that grains in the primary recrystallized structure have a homogeneous grain diameter and a diameter larger than a given value.

On the other hand, it is necessary for the texture to have a suitable amount of a secondary recrystallizable grain having a {110}<001> orientation or the like and a suitable amount of a grain having a {111}<112> orientation or the like capable of facilitating the growth of a secondary recrystallized grain.

This is influenced by the crystal grain diameter of the steel strip before cold-rolling (recrystallization ratio), the amount of the transformation phase, the amount of C in a solid solution form, etc.

In the process of the present invention, the presence of the inhibitor before cold-rolling is unfavorable because this makes it difficult to regulate the primary recrystallized structure. However, the precipitation of AlN is unavoidable as long as Al and N are used as the composition of the material. For this reason, the control of fine precipitates having an effect on the growth of grain is important.

With respect to the function of AlN, AlN having a lower Al($Al_R$) value exhibits a stronger restraint for the growth of the primary recrystallized grain if the annealing condition is identical. In the annealing of the hot-rolled strip according to the present invention, the reason why the primary soaking temperature is varied depending upon the $Al_R$ value is that the size of the precipitation of AlN derived from the difference in the $Al_R$ is controlled by varying the annealing temperature of the hot-rolled strip to form a homogeneous primary recrystallized structure having a predetermined size or more through the elimination of the variation in the growth of a primary recrystallized grain.

The cooling from the secondary soaking temperature to room temperature at a rate of 10° C./sec or more is necessary for ensuring a given size and given amounts of a transformation phase and C in a solid solution form, and this as well appears to play an important role in optimizing the primary recrystallized coalesced structure.

The optimization of the structure and the texture can be attained through a combination of the above-described cooling rate with the temperature of decarburization annealing conducted after cold rolling. In order to obtain a high magnetic flux density ($B_8$), it is necessary to conduct the cold-rolling with a final rolling reduction of 80% or more. As described above, the decarburization annealing serves to decarburize the steel strip and, at the same time, to form an oxide layer necessary for the regulation of the primary recrystallized structure and the formation of the glass film, and is usually conducted in a mixed gas comprising a humid hydrogen and a nitrogen gas in a temperature region of 800° to 900° C. Specifically, the gas constituting the atmosphere is preferably a mixed gas comprising hydrogen and nitrogen which has a dew point of 30° C. or above.

In the decarburization annealing, after the strip is coated with an annealing separator comprising MgO and $TiO_2$ and, added thereto, an agent having a nitriding capability such as MnN, CrN, etc., finish annealing is conducted at a temperature of 1100° C. or above. It is also possible to use a gas having a nitriding capability as a gas constituting the atmosphere for the finish annealing. In a further embodiment, after the decarburization annealing, the steel strip may be annealed in an atmosphere containing a gas having a nitriding capability such as $NH_3$ at a temperature of 700° to 800° C. in a short time to nitrify the steel strip, coated with a known annealing separator and then subjected to finish annealing.

The function and effect of the present invention will now be described in more detail with reference to the following Examples.

EXAMPLE 1

Three kinds of steel ingots different from each other in the acid soluble Al content were prepared by adding Al in varied amounts to a molten steel comprising 0.050% of C, 3.50% of Si, 0.12% of Mn, 0.008% of S, 0.0076% of N, 0.05% of Sn and 0.12% of Cr.

Acid soluble [Al]
(a) 0.023%
(b) 0.028%
(c) 0.034%

These steel ingots were heated at 1150° C. and hot-rolled into hot-rolled strips having a thickness of 2.0 mm.

Thereafter, annealing of the hot-rolled strips was conducted under the following conditions (i) 1130° C.×2 min (time in furnace)+900° C.×2 min (time in furnace) →quenching in 100° C. water
(ii) 1000° C.×2 min (time in furnace)+900° C.×2 min (time in furnace) →quenching in 100° C. water
(iii) 950° C.×2 min (time in furnace)+900° C.×2 min (time in furnace) →quenching in 100° C. water Thereafter, the strips were cold-rolled into a thickness of 0.23 mm and then subjected to decarburization annealing at 835° C. for 90 sec in an atmosphere having a dew point of 65° C. and comprising humid hydrogen and nitrogen. Subsequently, a nitriding treatment was conducted at 750° C. for 30 sec in an atmosphere comprising a mixed gas comprising dry nitrogen and hydrogen and, added thereto, ammonia to bring the nitrogen content after nitriding to 200 ppm. Thereafter, the steel strips were coated with a slurry composed mainly of MgO and $TiO_2$, dried and subjected to finish annealing at 1200° C. for 20 hr.

Magnetic properties after finish annealing are given in Table 3.

TABLE 3

| Sample (Tesla) | Residual [Al] ($Al_R$) (ppm) | Magnetic flux density conditions for annealing of hot-rolled strips (i) | (ii) | (iii) |
|---|---|---|---|---|
| a | 84 | 1.94 | 1.90 | 1.87 |
| b | 134 | 1.90 | 1.95 | 1.91 |

TABLE 3-continued

| Sample (Tesla) | Residual [Al] ($Al_R$) (ppm) | Magnetic flux density conditions for annealing of hot-rolled strips (i) | (ii) | (iii) |
|---|---|---|---|---|
| c | 194 | 1.82 | 1.92 | 1.95 |

From Table 3, it is apparent that in the case of the sample a having a low $Al_R$ value, a high magnetic flux density is obtained at a high primary soaking temperature in the annealing of the hot-rolled strip while in the case of the samples b and c having a higher $Al_R$ value, a high magnetic flux density is obtained at a lowered primary soaking temperature in the annealing of the hot-rolled strip. The annealing conditions satisfy the constituent features of the present invention.

EXAMPLE 2

Two kinds of steel ingots different from each other in the acid soluble Al content were prepared by adding Al in varied amounts to a molten steel comprising 0.054% of C, 3.30% of Si, 0.14% of Mn, 0.007% of S, 0.0074% of N, 0.03% of Sn and 0.08% of Cr.

| Acid soluble [Al] | $Al_R$ |
|---|---|
| (a) 0.027% | 128 ppm |
| (b) 0.035% | 208 ppm |

These steel ingots were heated and hot-rolled into hot-rolled strips having a thickness of 1.6 mm. Thereafter, annealing of the hot-rolled strips was conducted under the following conditions.

(i) 1050° C.×2 min (time in furnace)+850° C.×2 min (time in furnace) →quenching in 80° C. water
(ii) 900° C.×2 min (residence in furnace)+850° C.×2 min (residence in furnace) →quenching in 80° C. water Thereafter, the strips were cold-rolled into a thickness of 0.17 mm and then subjected to decarburization annealing at 830° C. for 70 sec in an atmosphere having a dew point of 65° C. and comprising hydrogen and nitrogen. Subsequently, a nitriding treatment was conducted at 750° C. for 30 sec in an atmosphere comprising a mixed gas comprising dry nitrogen and hydrogen and, added thereto, ammonia to bring the nitrogen content after nitriding to 230 ppm. Thereafter, the steel strips were coated with a slurry composed mainly of MgO and $TiO_2$, dried and subjected to finish annealing at 1200° C. for 20 hr.

Magnetic properties after finish annealing are given in Table 4.

TABLE 4

| Sample | $Al_R$ (ppm) | Magnetic flux density (Tesla) conditions for annealing of hot-rolled strips (i) | (ii) |
|---|---|---|---|
| a | 128 | 1.93 | 1.91 |
| b | 208 | 1.90 | 1.94 |

The conditions for annealing of the hot-rolled strips which provided a magnetic flux density of 1.93 Tesla or more satisfy the constituent features of the present invention.

EXAMPLE 3

Two kinds of steel ingots different from each other in the acid soluble Al content were prepared by adding Al in varied amounts to a molten steel comprising 0.050% of C, 3.2% of Si, 0.10% of Mn, 0.010% of S, 0.0076% of N, 0.05% of Sn and 0.10% of Cr.

| Acid soluble [Al] | $Al_R$ |
|---|---|
| (a) 0.025% | 104 ppm |
| (b) 0.032% | 174 ppm |

These steel ingots were heated and hot-rolled into hot-rolled strips having a thickness of 2.7 mm, and then pickled and cold-rolled into a thickness of 2.2 mm. Thereafter, the cold-rolled strips was annealed under the following conditions.

(i) 1100° C.×2 min (time in furnace)+900° C.×2 min (time in furnace) →quenching in 80° C. water (ii) 900° C.×2 min (time in furnace)+900° C.×2 min (time in furnace) →quenching in 80° C. water Thereafter, the strips were further cold-rolled into a thickness of 0.27 mm and then subjected to decarburization annealing at 840° C. for 120 sec in an atmosphere comprising humid hydrogen and nitrogen.

Subsequently, a nitriding treatment was conducted at 750° C. for 30 sec in an atmosphere comprising a mixed gas comprised of dry nitrogen and hydrogen and, added thereto, ammonia to bring the nitrogen content after nitriding to 200 ppm. Thereafter, the steel strips were coated with an annealing separator and subjected to finish annealing at 1200° C. for 20 hr.

Magnetic properties after finish annealing are given in Table 5.

TABLE 5

| Sample | $Al_R$ (ppm) | Magnetic flux density (Tesla) conditions for annealing of cold-rolled strips (i) | (ii) |
|---|---|---|---|
| a | 104 | 1.93 | 1.89 |
| b | 174 | 1.87 | 1.94 |

From Table 5, it is apparent that in the two-stage cold rolling process as well, a good magnetic property can be obtained when the conditions satisfy the constituent features of the present invention.

Thus, a grain-oriented electrical steel strip having a very high magnetic density can be stably prepared through the establishment of a proper relationship between the Al and N ingredients and conditions for annealing of a steel strip before final cold rolling and the growth of a primary recrystallized grain to optimize the annealing conditions and the practice of a nitriding treatment after decarburization annealing.

What is claimed is:

1. A process for producing a grain-oriented electrical steel strip having a high magnetic flux density, comprising the steps of:

heating an electrical steel slab comprising, by weight, 0.025 to 0.075% of C, 2.5 to 4.5% of Si, 0.015% or less of S, 0.015 to 0.040% of acid-soluble Al, less than 0.010% of N and 0.050 to 0.45% of Mn with the balance Fe and unavoidable impurities at a temperature of 1200° C. or below;

hot-rolling the heated slab into a hot-rolled steel strip;

cold-rolling the hot-rolled steel strip once or two times or more with intermediate annealing being conducted between the cold rollings into a cold-rolled steel strip with a final rolling reduction of 80% or more; and subjecting the cold-rolled steel strip to decarburization annealing and finish annealing, said process further comprising, subjecting the strip to a two-stage soaking process after said hot rolling and prior to said final cold rolling with a first soaking stage being at a higher temperature T°C. and with a second soaking stage being at a lower temperature;

determining $Al_R$ from the equation $Al_R$=acid soluble Al−27/14N where Al and N are in ppm and are determined from the composition of said hot rolled strip;

determining the higher temperature T°C. from the equation $$1240-(2.1\times Al_R)<T<1310-(1.8\times Al_R)$$

wherein T°C. is limited to a maximum temperature of 1150° C. and a minimum temperature of 950° C.;

soaking the strip at the determined temperature, T°C., for 180 sec or less;

holding the strip at the lower soaking temperature of 800° C. to 950° C. for 30 to 300 sec and cooling the strip to room temperature at a rate of 10° C./sec or more;

and the steel strip is nitrided between when said decarburization annealing is completed and when the temperature reaches a secondary recrystallization initiation temperature of the steel strip in said finish annealing.

2. A process for producing a grain-oriented electrical steel strip having a high magnetic flux density according to claim 1, wherein the electrical steel slab as the starting material comprises, by weight, 0.025 to 0.075% of C, 2.5 to 4.5% of Si, 0.015% or less of S, 0.015 to 0.040% of acid-soluble Al, less than 0.010% of N, 0.050 to 0.45% of Mn, 0.02 to 0.15% of Sn and 0.05 to 0.15% of Cr with the balance consisting of Fe and unavoidable impurities.

* * * * *

US005261972C1

(12) EX PARTE REEXAMINATION CERTIFICATE (9971st)

United States Patent
Kuroki et al.

(10) Number: US 5,261,972 C1
(45) Certificate Issued: Dec. 5, 2013

(54) PROCESS FOR PRODUCING GRAIN-ORIENTED ELECTRICAL STEEL STRIP HAVING HIGH MAGNETIC FLUX DENSITY

(75) Inventors: Katsuro Kuroki, Kitakyushu (JP); Yasunari Yoshitomi, Kitakyushu (JP); Hiroaki Masui, Kitakyushu (JP); Tsutomu Haratani, Kitakyushu (JP)

(73) Assignee: Nippon Steel Corporation, Chiyoda-Ku, Tokyo (JP)

Reexamination Request:
No. 90/012,482, Sep. 10, 2012

Reexamination Certificate for:

| | |
|---|---|
| Patent No.: | **5,261,972** |
| Issued: | **Nov. 16, 1993** |
| Appl. No.: | **07/965,650** |
| Filed: | **Oct. 22, 1992** |

(30) Foreign Application Priority Data

Oct. 28, 1991 (JP) ..... 3-281072

(51) Int. Cl.
*C21D 8/12* (2006.01)
*C21D 1/18* (2006.01)

(52) U.S. Cl.
CPC ..... *C21D 8/1261* (2013.01); *C21D 8/1266* (2013.01)
USPC ..... 148/111; 148/113

(58) Field of Classification Search
None
See application file for complete search history.

(56) References Cited

To view the complete listing of prior art documents cited during the proceeding for Reexamination Control Number 90/012,482, please refer to the USPTO's public Patent Application Information Retrieval (PAIR) system under the Display References tab.

*Primary Examiner* — Carlos Lopez

(57) ABSTRACT

The present invention discloses a process for producing a grain-oriented electrical steel strip having a high magnetic flux density. The process comprises hot-rolling a steel ingot comprising basic ingredients and, added thereto, 0.02 to 0.15% of Sn at a temperature of 1200° C. or below, annealing the hot-rolled strip, cold-rolling the annealed strip with a final rolling reduction of 80% or more and subjecting the cold-rolled strip to decarburization annealing, a nitriding treatment and finish annealing, wherein the temperature, T°C., of annealing of the hot-rolled strip is set so as to fall within the range 1240–2.1×Alhd R<T<1310–1.8×$Al_R$ (wherein $Al_{R-}$=acid soluble [Al]–27/14×[N]) and the strip is soaked for 180 sec or less, maintained at a temperature in the range of from 800° to 950° C. for 30 to 300 sec and then quenched. The grain-oriented electrical steel strip thus produced is not influenced by the variation in the [Al] and [N].
According to the present invention, a grain-oriented electrical steel strip having a very high magnetic density can be stably prepared through the establishment of a proper relationship between the Al and N ingredients and conditions for annealing of a steel strip before final cold rolling and the growth of a primary recrystallized grain to optimize the annealing conditions and the practice of a nitriding treatment after decarburization annealing.

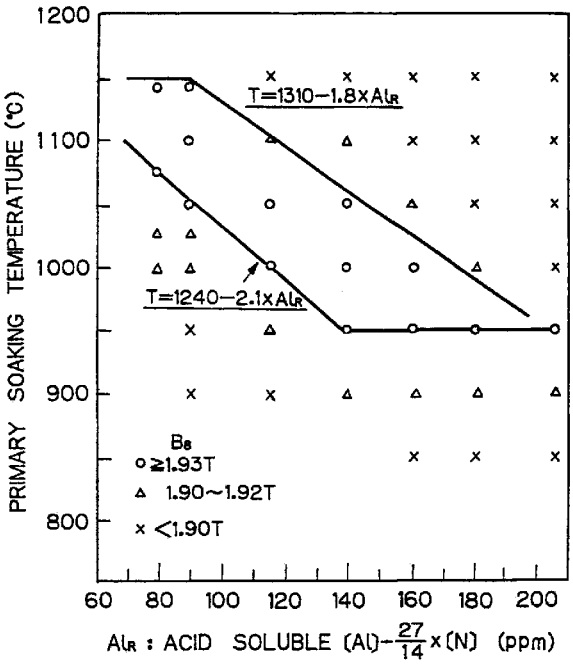

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-2 is confirmed.

* * * * *